US006314951B1

(12) United States Patent
Wenger et al.

(10) Patent No.: US 6,314,951 B1
(45) **Date of Patent: *Nov. 13, 2001**

(54) GAS-DYNAMIC PRESSURE-WAVE MACHINE

(75) Inventors: Urs Wenger, Langenthal; Roger Martin, Othmarsingen, both of (CH)

(73) Assignee: Swissauto Engineering S.A. (CH)

( * ) Notice: Subject to any disclaimer, the term of this patent is extended or adjusted under 35 U.S.C. 154(b) by 0 days.

This patent is subject to a terminal disclaimer.

(21) Appl. No.: 09/486,452

(22) PCT Filed: Aug. 25, 1998

(86) PCT No.: PCT/EP98/05379

§ 371 Date: Feb. 25, 2000

§ 102(e) Date: Feb. 25, 2000

(87) PCT Pub. No.: WO99/11915

PCT Pub. Date: Mar. 11, 1999

(30) Foreign Application Priority Data

Aug. 29, 1997 (EP) ..... 97810614

(51) Int. Cl.[7] ..... F02B 33/00
(52) U.S. Cl. ..... 123/559.2; 417/64
(58) Field of Search ..... 123/559.2; 60/600, 60/601, 602, 603, 39.45; 417/64

(56) References Cited

U.S. PATENT DOCUMENTS 4,702,218 * 10/1987 Yoshioka et al. ..... 123/559.2
4,808,082 * 2/1989 Kirchhofer et al. ..... 417/64
4,910,959 * 3/1990 Dones ..... 123/559.2 X
5,284,123 2/1994 Dones .

FOREIGN PATENT DOCUMENTS 681738 5/1993 (CH) .
61-028717 2/1986 (JP) .
97/20134 6/1997 (WO) .

* cited by examiner

*Primary Examiner*—Hoang Nguyen
(74) *Attorney, Agent, or Firm*—Ostrolenk, Faber, Gerb & Soffen, LLP

(57) ABSTRACT

The gas-dynamic pressure wave machine which is destined for the charge air supply of an internal combustion engine comprises a rotor (6, 40) with cells (18, 41), a low pressure fresh air inlet channel (14, 38), a high pressure charge air channel (10, 32) leading to the internal combustion engine (1, 33), a high pressure exhaust channel (3, 31) coming from the internal combustion engine, and a low pressure exhaust channel (4, 35), the low pressure exhaust channel (4, 35) and the high pressure exhaust channel (3, 31) being enclosed in a gas enclosure (5, 34) and the low pressure fresh air inlet channel (14, 38) and the high pressure charge air channel (10, 32) being enclosed in an air enclosure (15, 39). In order to eliminate the detrimental pressure pulsations, on one hand, and to increase the compression efficiency, on the other hand, a direct connection (46) is provided between the high pressure charge air channel (32) and the high pressure exhaust channel (31), which connection preferably comprises a nonreturn valve (47).

12 Claims, 3 Drawing Sheets

GAS-DYNAMIC PRESSURE-WAVE MACHINE

The present invention refers to a gas-dynamic pressure wave machine which is destined for the charge air supply of an internal combustion engine, comprising a rotor with cells, a low pressure fresh air inlet channel, a high pressure charge air channel leading to the internal combustion engine, a high pressure exhaust channel coming from the internal combustion engine, and a low pressure exhaust channel, the low pressure exhaust channel and the high pressure exhaust channel being enclosed in a gas enclosure and the low pressure fresh air inlet channel and the high pressure charge air channel being enclosed in an air enclosure. A pressure wave machine of this kind is known from the prior art, e.g. from CH-A-681 738.

Since the concept of the pressure wave machine of the prior art only allows a high efficiency in conjunction with a constant-pressure system which is as free of pulsations as possible, a volume is integrated in the exhaust manifold prior to the pressure wave machine in order to damp the motor pulsations. Without this damping action, the hard motor pulsations would enter the rotor through the exhaust channel of the gas enclosure, especially at lower motor speeds, and interfere with the proper pressure wave process of the pressure wave machine, resulting in a significant decrease in efficiency and to increased recirculation. The relatively large volume integrated in the exhaust manifold in front of the pressure wave machine is only capable of damping the pulsations partly, but not of eliminating them. Also, such an exhaust manifold volume is disadvantageous because of the larger construction volume and the higher heat capacity.

For high charging pressures and a high efficiency, standard pressure wave machines strongly depend on the filling degree. In the case of a low flow rate in the internal combustion engine, the filling degree of the rotor of the pressure wave machine will decrease and therefore also the charging pressure. In fact, in this area of the performance field, the machine is too big. In the case of a high flow rate in the internal combustion engine, the degree of filling strongly increases, and the compression efficiency deteriorates. Consequently, in this area of the performance field, the pressure wave machine is too small.

On the background of this prior art, it is the object of the present invention to provide a pressure wave machine which allows to eliminate the detrimental pulsations and to increase the compression efficiency with a reduced volume of the exhaust manifold. This object is attained by a pressure wave machine wherein a connection is provided between the high pressure charge air channel and the high pressure exhaust channel.

The invention will be explained in more detail hereinafter with reference to a drawing of exemplary embodiments.

Figure 1:
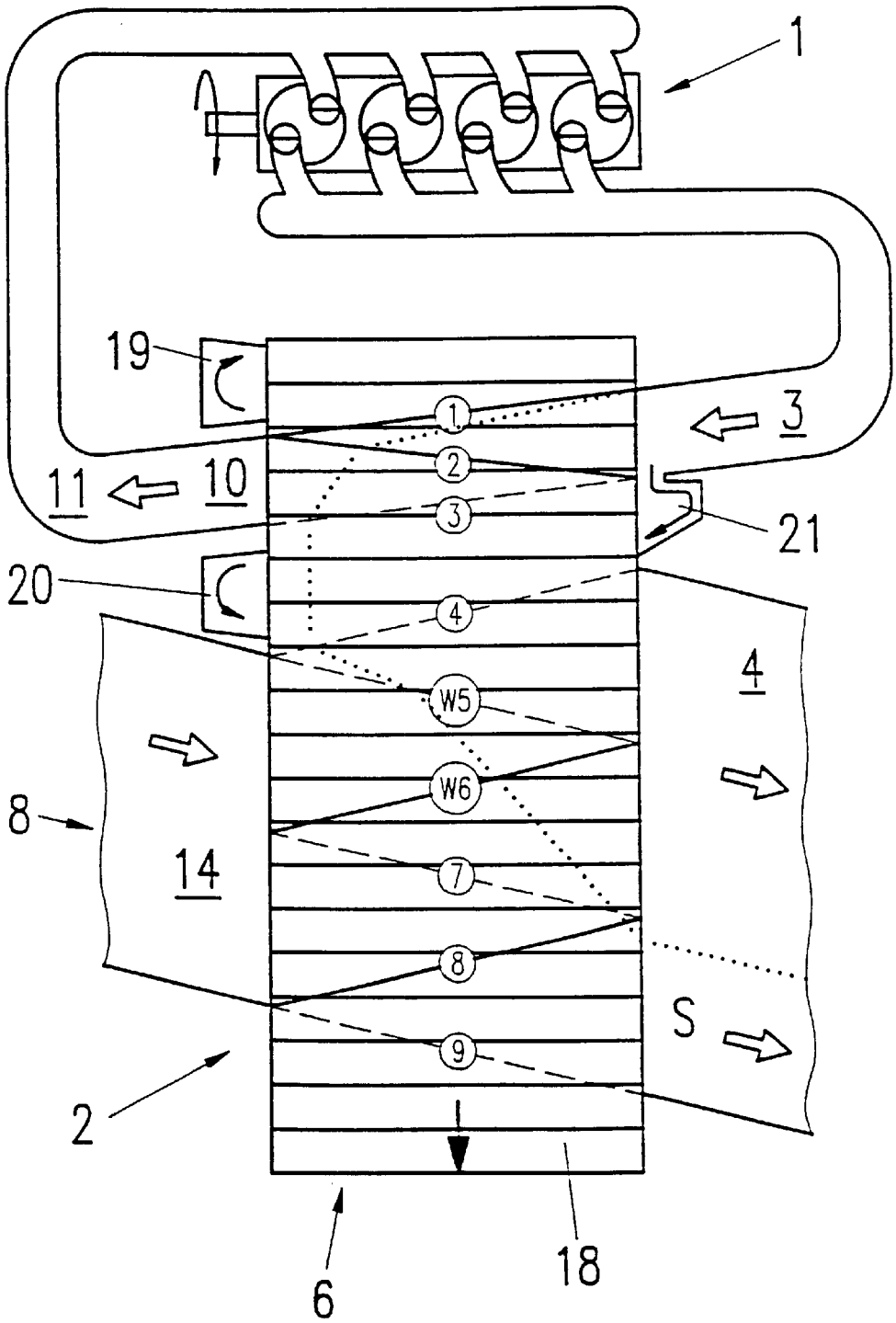
Figure 2:
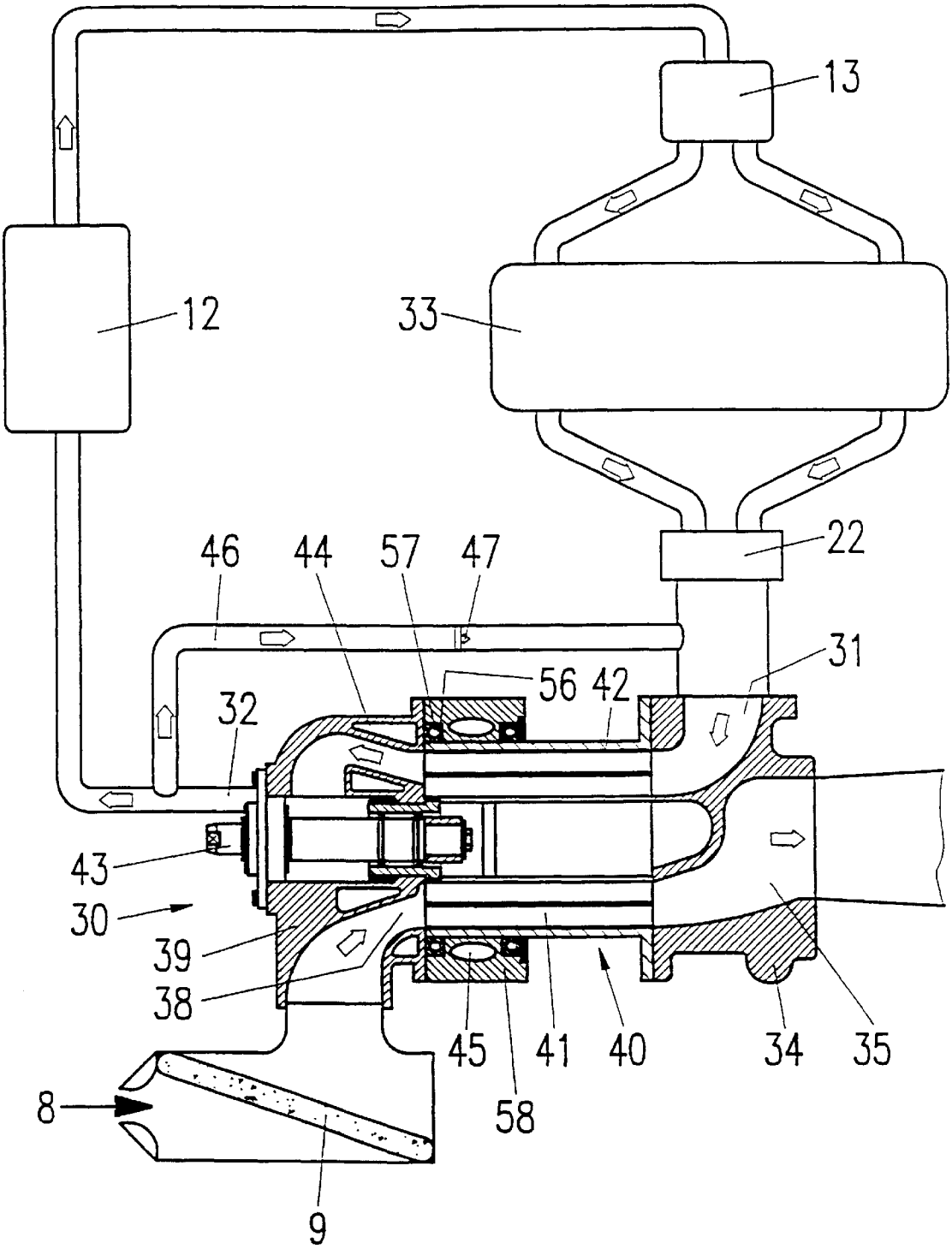
Figure 3:
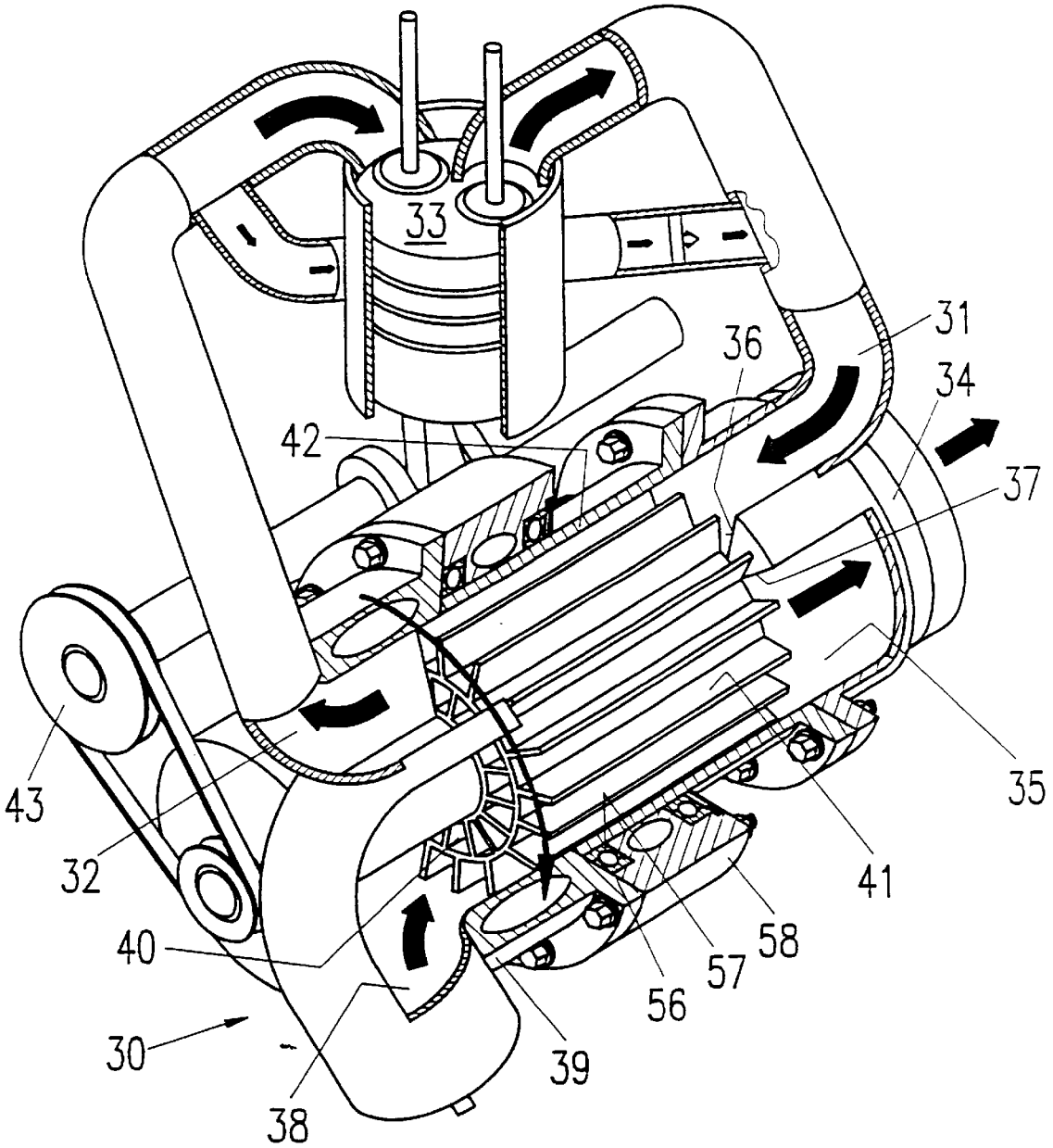

FIG. 1 schematically shows a developed cylindrical section through the cells of the rotor of a pressure wave machine according to the prior art;

FIG. 2 shows a general view of a gas-dynamic pressure wave machine of the invention; and FIG. 3 shows a perspective view of the gas-dynamic pressure wave machine of FIG. 2.

For the sake of simplicity, a single pressure wave cycle is described and represented in the developed view of FIG. 1 while FIGS. 2 and 3 show a two-cycle machine. However, the invention is independent from the number of pressure wave cycles, and it may be applied to pressure wave machines having a single cycle or two or more cycles.

FIG. 1 shows a developed view of the rotor of a pressure wave machine according to the prior art, as well as internal combustion engine 1, gas-dynamic pressure wave machine 2, high pressure exhaust channel 3 and low pressure exhaust channel 4 including scavenging air S, rotor 6 with individual cells 18, fresh air inlet 8 resp. low pressure fresh air inlet channel 14, and high pressure charge air channel 10 which communicates with charge air passage 11 and leads to internal combustion engine 1.

FIGS. 2 and 3 illustrate a gas-dynamic pressure wave machine according to the invention which comprises a number of improvements in order to essentially increase the overall efficiency. Pressure wave machine 30 is connected to schematically illustrated internal combustion engine 33 by high pressure exhaust channel 31 and high pressure charge air channel 32. Gas enclosure 34 further comprises low pressure exhaust channel 35, and this figure shows that the two channels, i.e. the high pressure exhaust channel and the low pressure exhaust channel, enter the gas enclosure on the rotor side in the form of sector-shaped openings having each an opening edge 36 and 37, respectively. Further illustrated is rotor 40 with its cells 41, the rotor being arranged in an envelope 42 and driven e.g. by means of a belt drive 43.

As already mentioned in the introduction, the exhaust manifold volume used in the pressure wave machines of the prior art in order to damp the motor pulsations must be relatively large, but it is nevertheless incapable of eliminating the detrimental pulsations. The pressure wave machine represents an open system, i.e. there is a direct connection between the exhaust section and the fresh air section through the rotor. However, this also transmits the motor pressure pulsations from the exhaust high pressure section to the fresh air high pressure section.

This drawback can now be eliminated by a direct fresh air supply to the exhaust channel. FIGS. 2 and 3 show the connection 46 leading from high pressure charge air channel 32 to high pressure exhaust channel 31, whereby the positive pressure pulses in the high pressure charge air channel are transmitted to the high pressure exhaust channel. The connection comprises a nonreturn valve 47 comprising an electronic regulation, as the case may be. The nonreturn valve acts as a regulation in the sense that only those pressure pulses are transmitted whose energetic level is higher than the current pressure in the high pressure exhaust channel. This allows to offset mainly the negative pressure pulses, i.e. the condition of quasi-negative pressure in the high pressure exhaust channel, and thus to raise the overall pressure level both in the high pressure exhaust channel and in the high pressure charge air channel due to the smoothing of the negative pressure pulses. Consequently, the pressure level in the rotor prior to opening the high pressure channel is significantly raised, and the pulsations arriving from there are damped. Furthermore, this measure allows to reduce the admission losses of the hot exhaust gases in the rotor since the entire process is damped.

A further improvement is obtained if the bifurcation, which in FIG. 2 or 3 is located anywhere between the high pressure charge air channel edge and the motor inlet, is provided directly after the opening edge of the high pressure charge air channel. This embodiment is not illustrated for the sake of clarity.

As previously mentioned, the pressure wave machine of the prior art is strongly dependent on the filling degree. In addition to a reduction of the pressure pulsations, as described above, the presence of a connection allows the feedback of charge air to the high pressure exhaust side of the pressure wave machine and thus an increase of the mass flow of the machine and thereby an increase of the filling degree, which results in a significant pressure increase. An additional regulation of the feedback amount of high pressure charge air by means of the regulated nonreturn valve may thus be used as a charging pressure regulation in general and additionally as a power regulation in the case of a spark ignition engine.

In other words, this means that in order to improve the compression efficiency at higher motor flow rates, the pressure wave machine may be designed somewhat larger without losing charging pressure at lower motor flow rates. This may also be obtained e.g. by regulating the cross-sectional area of the connecting channel by means of a suitable known device such as a controlled nonreturn valve an additional device for the regulation of the cross-sectional area. This is especially effective in the lower to medium speed, temperature, and load range of the internal combustion engine.

What is claimed is:

1. A gas-dynamic pressure wave machine for a charge air supply of an internal combustion engine, the pressure wave machine comprising:

a rotor;

an air housing having an air inlet channel in communication with the rotor and a charge air channel leading from the rotor to the internal combustion engine;

a gas housing having a first exhaust channel leading from the internal combustion engine to the rotor and a second exhaust channel in communication with the rotor and leading to the outside; and a dampening connection without a turbo charger and located between the charge air channel and the first exhaust channel, the dampening connection operable to remove detrimental pressure pulses and thereby raise pressure and compression efficiency of the pressure wave machine.

2. The gas-dynamic pressure wave machine of claim 1, wherein the air inlet channel has a lower pressure than that of the charge air channel.

3. The gas-dynamic pressure wave machine of claim 1, wherein the first exhaust channel has a higher pressure than that of the second exhaust channel.

4. The gas-dynamic pressure wave machine of claim 1, wherein the connection comprises a nonretum valve operable to prevent exhaust gas from entering the charge air channel.

5. The gas-dynamic pressure wave machine of claim 4, wherein said nonreturn valve is controlled by an electronic circuit.

6. The gas-dynamic pressure wave machine of claim 1, wherein a cross-sectional area of the connection is variable by means of a regulating device.

7. The gas-dynamic pressure wave machine of claim 1, wherein the connection bifurcates near an opening edge of the charge air channel.

8. The gas-dynamic pressure wave machine of claim 4, wherein a cross-sectional area of the connection is variable by means of a regulating device.

9. The gas-dynamic pressure wave machine of claim 5, wherein a cross-sectional area of the connection is variable by means of a regulating device.

10. The gas-dynamic pressure wave machine of claim 4, wherein the connection bifurcates near an opening edge of the charge air channel.

11. The gas-dynamic pressure wave machine of claim 5, wherein the connection bifurcates near an opening edge of the charge air channel.

12. The gas-dynamic pressure wave machine of claim 6, wherein the connection bifurcates near an opening edge of the charge air channel.

* * * * *